United States Patent [19]

Stumpf

[11] 4,234,984

[45] Nov. 25, 1980

[54] POCKETED SPRING ASSEMBLY

[75] Inventor: Walter Stumpf, Dunwoody, Ga.

[73] Assignee: Simmons Company, Atlanta, Ga.

[21] Appl. No.: 22,067

[22] Filed: Mar. 19, 1979

[51] Int. Cl.[2] ..... A47C 27/04

[52] U.S. Cl. ..... 5/477; 5/475; 53/467

[58] Field of Search ..... 5/475, 477, 478, 481; 156/353, 358, 360, 380; 53/467

[56] References Cited

U.S. PATENT DOCUMENTS

| | | | |
|---|---|---|---|
| 1,140,973 | 5/1915 | Foill | 5/247 |
| 1,226,219 | 5/1917 | Karpen | 5/477 |
| 1,270,840 | 7/1918 | Kelly | 5/477 |
| 1,284,384 | 11/1918 | Lewis | 5/477 |
| 1,741,847 | 12/1929 | Kaspar | 5/475 |
| 1,745,986 | 2/1930 | Edwards | 5/475 |
| 2,805,429 | 9/1957 | Woller | 5/477 |
| 3,844,869 | 10/1974 | Rust, Jr. | 156/358 |
| 3,869,739 | 3/1975 | Klein | 5/477 |

*Primary Examiner*—Casmir A. Nunberg

*Attorney, Agent, or Firm*—Fitch, Even, Tabin, Flannery & Welsh

[57] ABSTRACT

In the disclosed assembly of pocketed springs, adjacent strips of the pocketed springs are joined together by connecting the pocket material of adjacent strips together between two consecutive springs of the two strips. Each interior strip of springs in the assembly is connected alternately to the adjacent strip on either sides, and in the preferred arrangement depicted in the drawings, the connections of each such strip to its adjacent strip on either side are made at intervals of two springs, and near both ends of the springs.

9 Claims, 3 Drawing Figures

POCKETED SPRING ASSEMBLY

This invention relates to assemblies of pocketed spring coils for use as the resilient cores of mattresses, cushions, and the like. In particular, it concerns a method and pattern of assembly of the pocketed spring coils in a "square" array, i.e., with each spring coil disposed in two rows at right angles to one another, which is maintained by a novel pattern of interconnection of the pocket material of adjacent strips of springs.

The manufacture of pocketed springs for upholstery purposes is typically carried out in such a way that the pocketed coils are connected together as a continuous strip of indefinite length resembling a cartridge bandolier in appearance. A strip of such springs, if the pockets therein are defined by sewing, may be produced on a machine such as that disclosed in U.S. Pat. No. 1,733,660 issued in 1929 to the assignee of this invention on the application of John F. Gail.

Assemblies or "constructions" of such springs are made by winding or folding or otherwise laying up a strip or strips of springs into an assembly, usually, but not necessarily, of overall rectangular shape, with successive rows of springs in a touching relationship in which the springs may be staggered, i.e., with each spring nested in the depression formed between two springs of the adjacent strip row, or in square array in which each spring is disposed simultaneously in two rows, e.g., one longitudinal and one transverse, which are perpendicular to each other.

Inasmuch as successive strips tend to fall naturally into the nested staggered relation, in which a given number of coils will occupy the least space, they are commonly connected together in that fashion into "constructions" or cores for further upholstery as mattresses or cushions. See, for example, U.S. Pat. No. 2,805,429, issued in 1957 to the assignee of this application on the application of Edward E. Woller. The nested or offset relation of the coils is accentuated at the ends of any rectangular assembly, and may require special upholstery treatment at certain corners of the mattress if the desired overall dimensions and coil size should dictate an even number of rows of pocketed strips.

The "square" array is well-known, and would, from the standpoint of the uniformity of its corners and edges, be desirable for use in mattresses. However, because of the tendency of the adjacent strips of coils to move into the nested, minimum-space relationship, special effort is required to maintain the square array. In the past, this has been done by securing the touching springs of adjacent strips to each other top and bottom so that each spring, as well as being positioned in one row by virtue of its fabric connection to its flanking springs within the strip, was also attached top and bottom to its touching springs of the transverse row.

Such inter-spring connections, however, could only be made conveniently in the top and bottom faces of the spring assembly, and were typically made by the use of hogrings or staples or other metal fasteners, as in U.S. Pat. Nos. 698,529, 1,270,840, and 2,071,540, or by upholstery twine ties, as are depicted, for example, in U.S. Pat. Nos. 1,140,973, 1,741,847, and 1,745,986.

This direct connection of the springs to one another in both faces of the spring assembly in every row transverse to the pocket strips is a costly, labor-intensive procedure. Moreover, from the standpoint of the use of such assemblies in mattresses, the independent spring action which can be realized in assemblies of pocketed spring coils is defeated by the direct coil-to-coil connection.

Specifically, the tying of the end convolutions of the springs directly to each other in the rows transverse to the pocket strip direction requires the deflection of several springs of a given transverse row upon the deflection of any given spring, the number of springs thus deflected depending upon the stiffness of the intercoil connection, i.e., the degree of articulation permitted, the diameter of the end convolutions, the stiffness of the coils in relation to the load, and perhaps other factors. Moreover, the direct intercoil connection of the springs into rows transverse to the pocket strip, by drawing the end convolutions of the coils into tight juxtaposition, militates against the use of the barrel-shaped coil, and the enhancement of individual coil action which can result from the barrel shape.

In summary, the direct spring-to-spring connection for maintaining pocketed spring coils in square array detracts from the ability of the spring assembly to conform to the body contours of a person reposed upon a mattress employing such a spring assembly, and was used more widely in seat cushions than as mattresses.

The spring assembly of the present invention provides a system and method of maintaining assemblies of pocketed spring coils in square array without the direct intercoil fasteners common in the prior art, so that the several advantages of the non-nested, square array are achieved without the disadvantages heretofore identified with it. The system of the invention contemplates the interconnection of adjacent pocketed strips by connecting the fabric strips together between springs, rather than by connecting the springs, so that, in effect, the interconnection of any spring with its adjacent springs in both of the perpendicular rows of which it is a part is accomplished in the same fashion, i.e., by the material of the pocket in which the spring is housed. This arrangement not only provides the upholstering advantages of the square array while preserving the individual coil action heretofore sacrificed by direct intercoil connection, it eliminates the tendency, sometimes exhibited by nested assemblies of pocketed springs, to trap an individual coil or coils in the partially compressed condition.

The invention is explained in the following specification in reference to the accompanying drawings in which.

GENERAL DESCRIPTION

Figure 1:
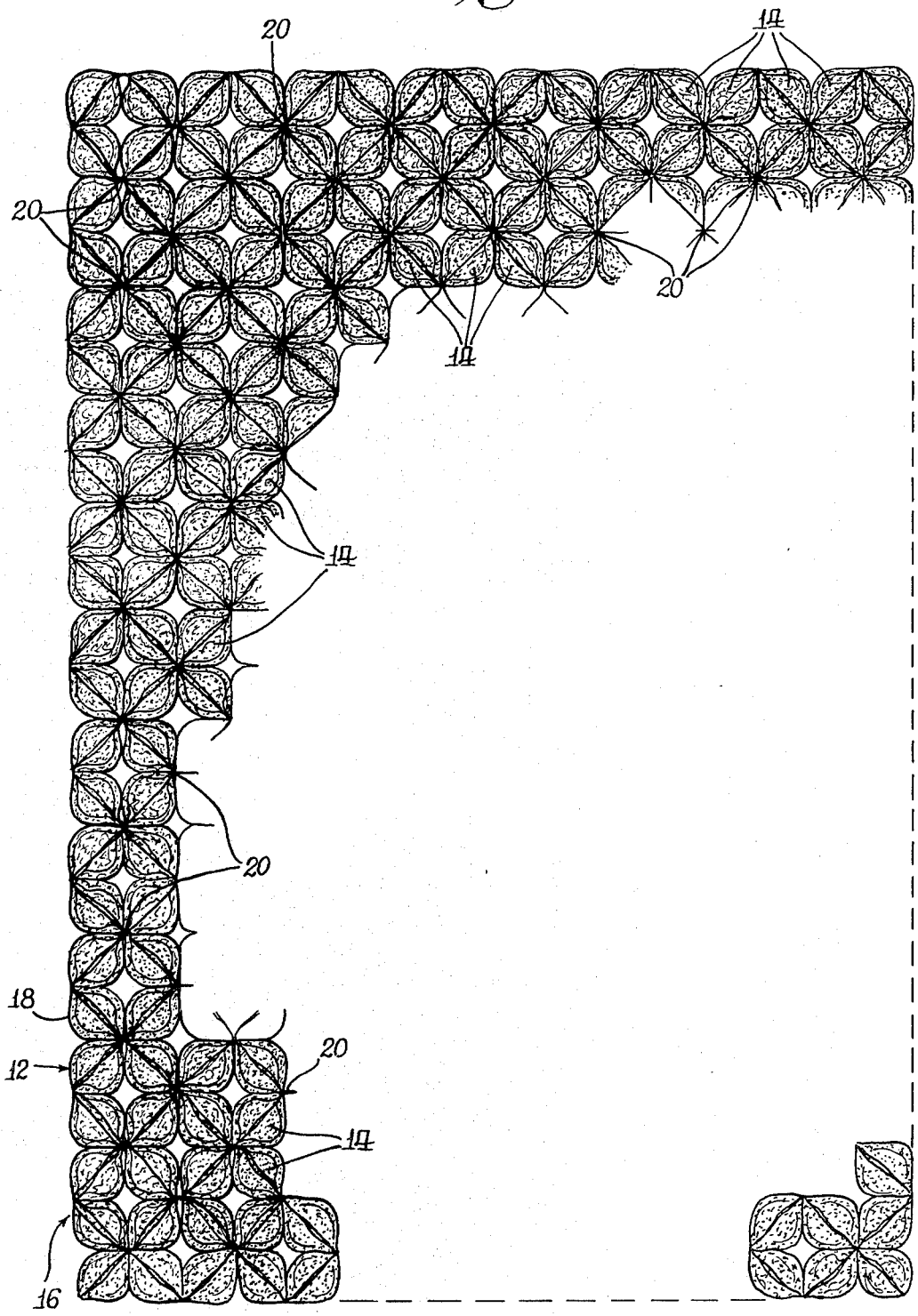
FIG. 1 is a plan view of one face of a rectangular pocketed spring assembly for a mattress, or cushion, or the like, with the springs disposed in non-nested square array, i.e., with each spring occupying simultaneously a position in two mutually perpendicular spring rows.

In a pocketed spring assembly 10 in accordance with the invention, as heretofore noted, a given strip 12 of pocketed springs 14 is connected to each adjacent strip 16 and 18 by connecting the two fabric strips together. Inasmuch as the overall pattern of the assembly tends to confuse the eye, reference should be made initially to the fragmentary enlargements of FIGS. 2 and 3, from which it will be more readily seen that the connections 20 of a given strip of springs to its neighboring strip are made between a pair of successive springs 14 of each strip, and are alternated along any given strip, e.g., strip 12, so that the given strip is connected first to the neighboring strip on one side, e.g., strip 16, and then to the neighboring strip on the opposite side, e.g., strip 18, and so forth, along the entire given strip from one end or side of the assembly to the other.

Figure 3:
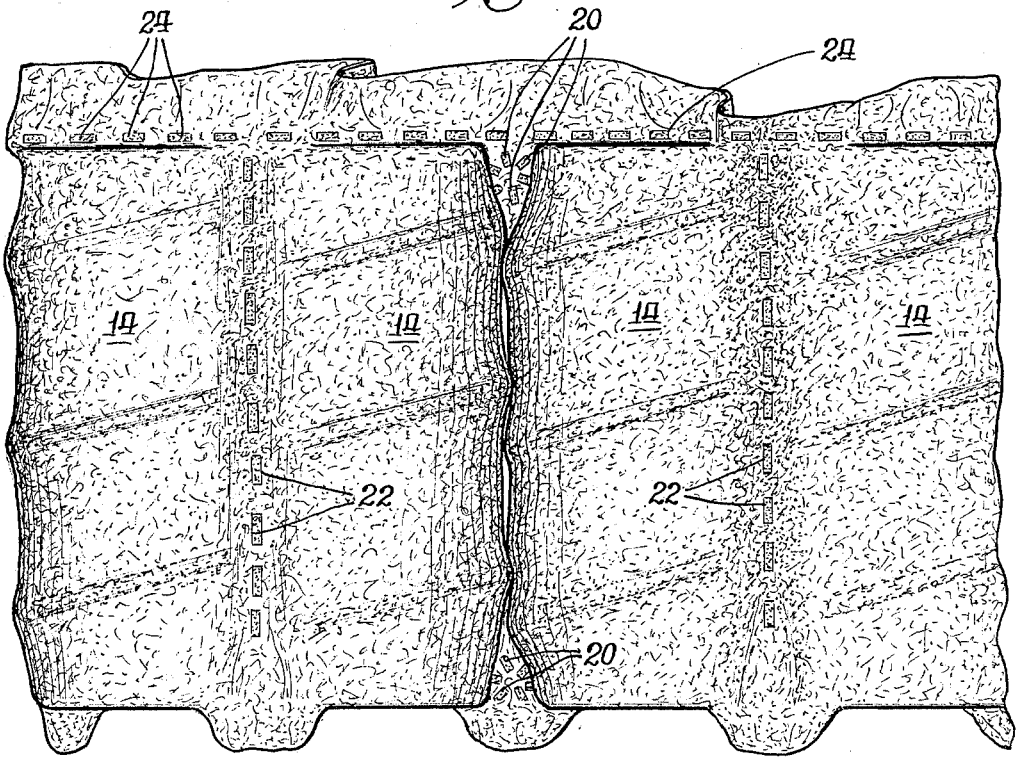
FIG. 3 is a corresponding fragmentary elevational view of the partial assembly shown in FIG. 2.

The interstrip connections 20 are conveniently, although not necessarily, made near the opposite faces of the spring assembly, where, because of the preferred barrel shape of the coil, the slack of the fabric between successive pockets near the ends of the coils facilitates the insertion of a tool appropriate to make the connection (FIG. 3).

As a result of the connection, the pair of coils of each strip immediately adjacent to the interstrip connection 20 are joined with an opposing pair in a configuration which, in plan, resembles a four-leaf clover, each spring pocket being rotated approximately one-eighth turn away from the longitudinal axis of its own strip.

DETAILED DESCRIPTION

The strips of pocketed coils 14 chosen to illustrate the invention are those produced commercially by the assignee of this invention and comprise a folded two-ply strip of non-woven fabric of thermoplastic fibers in which the spring pockets are defined between the plies by transverse lines 22 of discrete thermal welds of the plies to one another, and in which the pockets formed in the two-ply strip are closed by a longitudinal seam 24 of similar thermal welds to confine the springs in the pockets. When the springs are permitted to expand after being confined within the pockets, they impose their shapes upon the confining pocket walls in the mid-height of the pockets and produce a ruffle in the flaps of the closing seam, and at the opposite non-seamed end of the spring pocket as well, as the separation of the plies by the expanded spring foreshortens the cloth strip. This results in a slack reach of fabric along the inter-pocket seam 22 at each end thereof, an effect accentuated somewhat by the barrel shape of the coils 14 with which the invention is specifically illustrated.

The divergence of adjacent spring coils 14 at their ends resulting from the barrel shape provides convenient access to the strip material which, in the illustrated instance, is welded to the material of the adjacent strip in the corresponding reaches of fabric between two successive coils of each strip, so that in the presently preferred and illustrated form, the adjacent strips are connected together, as at 20, near the tops and bottoms of the coils, but preferably interiorly of the end convolutions thereof.

The interstrip welded connection 20, like the seams 22 defining the pockets in any given strip, also consists of a series of discrete welds arranged, however, in a circular pattern or "button". While the fabric preferred for the pocket material is one which is favorable to the employment of welding as the particular joining technique, the illustrated assembly system is not so limited, and can be executed in any kind of textile fabric or other appropriate sheet material by stitching, or by the use of metal staples or the like, as the art had long done with fabrics of natural fibers before the advent of thermoplastic fibers in the fabric context.

As pointed out in the foregoing general description, the making of the connections 20 draws the two flanking coils of each strip into mutual engagement at mid-height of the group of four coils surrounding each connection, locking them into a four-leaf clover pattern, with the closing seams of the pocket strips radiating from the connection as cross diagonals.

The assembly of springs by connecting the strips together, rather than by connecting the springs, as such, to one another, permits each spring to maintain a considerable degree of individual action before requiring the depression of its neighbors in the clover leaf array, and yet, beyond that point, as in areas of concentrated load under the proportionally heavier parts of the body, or when the spring assembly is highly loaded as by bearing the weight of the occupant in sitting position, the clover leaf connection of four springs together in a closely knit group associates them cooperatively so that each can assist the other to regain the full unloaded height permitted by the confining pocket when the concentrated load is subsequently removed.

Figure 2:
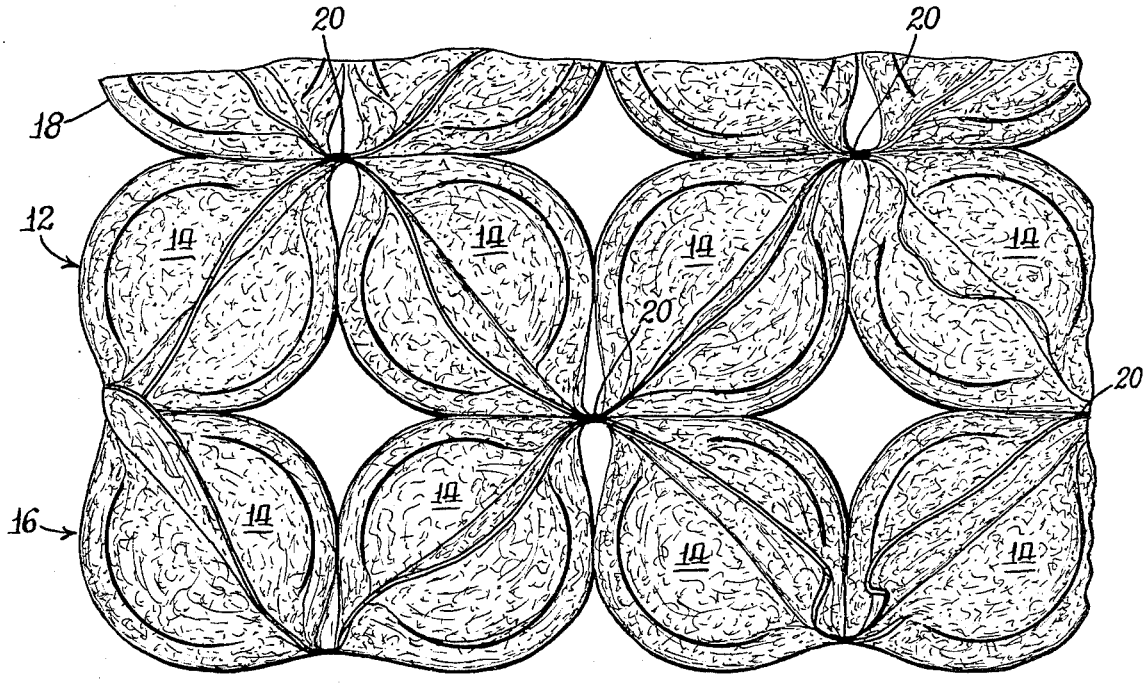
FIG. 2 is a fragmentary enlargement of one corner of an assembly such as that depicted in FIG. 1.

In the assembly illustrated in FIGS. 1 to 3 inclusive, the constituent strips of springs are assembled as consecutive rows of equal length which may run from top to bottom, or from side to side, as seen in FIG. 1, that particular form of lay-up being convenient to the assembly of a mattress-size construction in a vertical or near-vertical plane, particularly when, as illustrated, the assembly is made from a single continuous strip laid upon itself row by row in serpentine fashion.

Moreover, in the specifically illustrated preferred form, the connection of each given strip, such as strip 12, to any adjacent strip, such as strip 18, is made at 2-coil intervals. Its connections to the opposite adjacent strip, e.g., strip 16, are also made at 2-coil intervals, with the interstrip connections interspersed or staggered from strip to strip. In this arrangement, as will be noted more especially from FIG. 1, every interior coil of the assembly, considered individually, is simultaneously a constituent part of two diagonally connected clover leafs, and thus enjoys a cooperative association with six other springs.

The 2-coil interval between connections of coil strips in serpentine lay-up produces a construction which is uniform of configuration along all four edges of the assembly, all coils in each edge being in a straight line. Moreover, the reverse bending of each strip between successive connections to opposite adjacent strips tensions the pocket material so that, as successive strips are joined to their assembled predecessors, a taut, shape-retaining construction is achieved having uniform square corners at the junctures of straight, smooth, and uniform edges, with inherent diagonal bracing to maintain its trim shape and manufactured dimensions, with or without the addition of border wires.

To the extent that the rotational orientation of the individual springs in their respective pockets is uniform over a multi-row length of pocketed spring strip, the serpentine lay-up of consecutive strips as rows in either the longitudinal or transverse direction of the rectangular spring assembly tends to dispose the mid-convolution of the springs of adjacent strips at the same height, and therefore in intersecting or crossing contact, as distinguished from the interleaved or meshed association of consecutive springs in a given strip shown by FIG. 3. This can result in an audible relative re-adjustment of the springs of adjacent strips if they are released from compression sequentially, as by a body rolling in bed, if the spring strips run longitudinally of the assembly. This effect, however, is readily avoided by running the strips of pocketed springs transversely of the assembly so that the application and removal of the transient load occurs along all adjacent strips affected, rather than moving sequentially from strip to strip.

The longitudinal serpentine orientation may nevertheless be preferred for reduction of assembly time, and to the extent that audible spring interference is not muffled adequately by the upholstery of the spring assembly in such a mattress or cushion, it can also be avoided by reversing successive spring strips to turn the spring coils end for end. By that measure, successive strips of springs in common rotative orientation in their pockets will mesh in the same manner as successive springs in a given strip.

METHOD OF ASSEMBLY

As may already be evident from the foregoing description of a pocketed spring construction in accordance with the invention, the method of assembling the construction comprises juxtaposing the strips of springs, row upon row, whether by laying up precut rows of equal length, or by laying the rows up in serpentine fashion, or by spiral wrap, or by combinations of the above, and then connecting each strip to its immediately adjacent strip by joining them together along the seams between adjacent pockets of the strips, with those connections alternating from one side to the other of a given strip by joining it first to one adjacent strip, and then alternately to the opposite strip, and so on down each strip.

The preferred form illustrated is distinguished from other forms of the invention in several ways. First, the connections of any given strip to its neighbor are made at intervals of two coils, and the connections of the given strip to its opposite neighbor are also at 2-coil intervals interspersed with those of the first. The resulting pattern, as earlier noted, automatically places each spring in one row as a result of being an integral part of a strip of springs, and, at the same time, in a perpendicularly transverse row as a result of the connections between successive strips of the assembly. Also, when, as preferred, these connections are interspersed at 2-coil intervals, the springs are likewise connected in diagonal rows of substantially unyielding length which brace the assembly against wracking forces and maintain the construction square without the use of auxiliary framing, such as border wires, notwithstanding that, in certain applications, border wires may be employed for other purposes.

Secondly, the pocket material of the preferred assembly is a thermoplastic sheeting, preferably of fibrous material, whether or not of continuous filament or staple fiber length, and whether spun and woven, or laid as a non-woven fabric. When the constituent material is thermoplastic, as indicated, the joining technique employed in making the assembly, as well as making the pocketed spring strip itself, may be thermal welding, a localized or spot attachment of adjacent strips being made at or near the end convolutions of the springs along the seam between adjacent pockets in that relatively slack reach of the pocket material provided by the diverging outlines of the barrel-shaped spring coils resulting from the smaller diameter of their respective end convolutions. These connections can readily be made with available welding equipment, and do not appear to interfere materially with compression of the springs individually throughout a substantial portion of their respective heights.

As earlier indicated, and based upon the considerable history of manufacture of pocketed spring coil assemblies wherein the pocket materials were of spun and woven staple fibers of natural origin, the specific mode of attachment of adjacent strips to one another in accordance with the invention may be something specifically different from thermal welding, the ultimate objective being the secure, reliable, and non-destructive attachment of the adjacent strips to one another. This may, for example, take the form of stitching, or twine ties, or metal fasteners such as hogrings, staples, or the like, or an adhesive capable of adequately penetrating the four plies of a textile fabric with or without heat and pressure.

Based upon somewhat limited experience with the utilization of this novel method of assembling pocketed springs, the benefits of the method, apart from the aforementioned advantages of the physical form of the assembly itself, reside in the elimination of the labor-intensive scheme of connecting each coil to the next in the rows transverse to the axes of the several strips of springs. It is an assembly technique which can be executed by hand-held tools, but is also well adapted to execution by machine.

The features of the foregoing spring assembly and method believed new and patentable are set forth in the appended claims.

What is claimed is:

1. An improved assembly of pocketed wire coil springs for mattresses, cushions, or the like, of the type comprising a plurality of touching strips of integrally-connected springs confined in pockets defined between layers of elongated sheet material, the springs of said assembly being disposed in rectangular array in which any given pocketed spring is positioned in two rows at right angles to each other and in touching contact with the adjacent pocketed springs of said two rows, and each said given spring is one of such a strip of springs constituting one of said two rows of springs, the improvement comprising the connection of adjacent strips of springs together by joining the pocket material of said adjacent strips together between adjacent springs of each of said adjacent strips, said connections being made at intervals of at least two springs along each said strip, and said interstrip connections between successive adjacent strips being staggered from strip to strip.

2. The improvement of claim 1 wherein the two rows at right angles to each other are also each parallel and perpendicular, respectively, to any edge of the rectangular array.

3. The improvements of claim 1 or 2 wherein said interval between interstrip connections is two springs.

4. The improvements of claims 2 or 3 wherein adjacent strips of springs are the successive runs of a continuous serpentine strip of springs.

5. The improvement of claim 1 wherein the interstrip connection is made by joining the adjacent strips together at least adjacent to both ends of said adjacent springs.

6. The improvements of claims 1 or 5 wherein the pocket material is thermally weldable and the interstrip juncture is made by thermally fusing the pocket material of said strips.

7. The method of fabricating an assembly of integrally connected pocketed springs for mattresses, cushions, or the like from strips of such springs confined in pockets formed between elongated layers of flexible sheet material, and in which the springs are in square array with each spring disposed in two mutually perpendicular rows of said assembly, comprising placing multiple strips of such springs in juxtaposition with the axes of the springs parallel, connecting adjacent strips of springs by joining the pocket material of one strip to the pocket material of the other between pairs of successive springs of each strip at intervals of at least two springs, and staggering the said connections between successive strips.

8. The method of claim 7 wherein the pocket material of adjacent strips is joined by thermal fusion.

9. The method of claim 8 wherein the pocket material is thermally weldable.

* * * * *